US007467914B2

(12) United States Patent
Finn et al.

(10) Patent No.: US 7,467,914 B2
(45) Date of Patent: Dec. 23, 2008

(54) APPARATUS AND METHOD FOR SUPPORTING A STEEL CATENARY RISER

(75) Inventors: Lyle Finn, Sugar Land, TX (US); Gerald Crotwell, Sugar Land, TX (US)

(73) Assignee: Technip France, Courbevoie (FR)

( * ) Notice: Subject to any disclaimer, the term of this patent is extended or adjusted under 35 U.S.C. 154(b) by 380 days.

(21) Appl. No.: 11/225,148

(22) Filed: Sep. 13, 2005

(65) Prior Publication Data

US 2007/0056741 A1 Mar. 15, 2007

(51) Int. Cl.
*E21B 17/01* (2006.01)

(52) U.S. Cl. ..... 405/224.3; 405/224.2

(58) Field of Classification Search ..... 405/224, 405/224.2–224.4, 223.1; 166/345, 350, 359, 166/367

See application file for complete search history.

(56) References Cited

U.S. PATENT DOCUMENTS 3,727,954 A * 4/1973 Oliver ..... 405/224.2
4,363,567 A * 12/1982 Van der Graaf ..... 405/224.2
5,722,492 A 3/1998 Finn
5,873,677 A 2/1999 Davies et al.
6,648,074 B2 * 11/2003 Finn et al. ..... 405/224.4
6,746,182 B2 * 6/2004 Munk et al. ..... 405/224.2
7,217,067 B2 * 5/2007 Mao et al. ..... 405/224.2
2001/0031174 A1 * 10/2001 Olivier et al. ..... 405/224.2
2004/0197152 A1 * 10/2004 Beard et al. ..... 405/224
2007/0048094 A1 * 3/2007 Mao et al. ..... 405/224.4

* cited by examiner

*Primary Examiner*—Frederick L Lagman
(74) *Attorney, Agent, or Firm*—Klein, O'Neill & Singh, LLP

(57) ABSTRACT

An apparatus for supporting a steel catenary riser (SCR) from a floating structure having a keel includes a flexible support tube or keel sleeve through which the SCR passes. The support tube or keel sleeve includes a pivot mechanism that is lockably received in a receptacle fixed to the floating structure. A method of supporting an SCR from a floating structure includes the steps of inserting a first end of the SCR into a support tube or keel sleeve; fixing the support tube or keel sleeve to the SCR; pulling the support tube or keel sleeve into a receptacle fixed to the floating structure; releasing the support tube or keel sleeve from the SCR; pulling the SCR through the support tube or keel sleeve up to an attachment point on the structure; fixing the SCR to the structure; and fixing the support tube or keel sleeve to the SCR.

20 Claims, 9 Drawing Sheets

APPARATUS AND METHOD FOR SUPPORTING A STEEL CATENARY RISER

CROSS-REFERENCE TO RELATED APPLICATION

Not Applicable

FEDERALLY SPONSORED RESEARCH OR DEVELOPMENT

Not Applicable

BACKGROUND OF THE INVENTION

The present invention relates to the field of offshore drilling and production structures. More specifically, it relates to an apparatus for a supporting a steel catenary riser (SCR) extending to the seabed from a floating offshore structure (e.g., a platform or a vessel).

Offshore platforms used for the production of petroleum and natural gas from seabed wells frequently include one or more production risers for the extraction from the well of the product (petroleum or natural gas) and/or for the injection into the well of a fluid (gas or water) to aid in the extraction of the product. One type of riser that is well known and that is commonly used is a flexible steel riser known as a steel catenary riser, or "SCR."

The current practice in riser systems is to provide a pull tube for installing and supporting a steel catenary riser. A support section of the pull tube keeps the stresses in the riser within allowable limits during installation and operation. One prior art example is shown in FIG. 1, which represents an SCR support structure of the type shown in U.S. Pat. No. 5,722,492, the disclosure of which is incorporated herein by reference. A floating offshore structure 12 is held in position in a body of water 36 by mooring lines 14 that are secured to the seabed 16 by means such as anchors or pilings (not shown). An SCR 18 has a lower end attached to a wellhead (not shown) in the seabed 16. A flexible support tube 22 supports the SCR 18 within the structure 12. An upper portion 24 of the riser 18 extends up and through a center well 26 situated within the floating structure 12, for attachment thereto at a location 28.

The SCR 18 is pulled through the support tube 22 by pull-in rigging (not shown). The inside diameter of the support tube 22 must be large enough to allow the pull-in rigging to pass through it. As a result, the support tube 22 diameter is often considerably larger than the diameter of the SCR 18, wherein the relatively large diameter of the support tube 22 relative to that of the SCR 18 gives the support tube 22 a high degree of stiffness relative to the stiffness of the SCR 18. The high degree of stiffness of the support tube 22 (relative to the stiffness of the SCR 18) results in a concentration of bending strain in the SCR 18 at the location where the SCR 18 exits the support tube 22. This concentration of bending strain contributes to excessive stress and strain in the SCR 18.

It would thus be advantageous to provide a catenary riser support system that does not require the use of large diameter risers and support tubes with a large stiffness relative to the stiffness of the riser.

SUMMARY OF THE INVENTION

In one aspect of the present invention, in accordance with a preferred embodiment thereof, an apparatus for supporting an SCR having an upper end secured to a floating structure and a lower end secured to the seabed comprises a flexible support tube or keel sleeve that encloses the SCR, and that contains a latching pivot mechanism that selectively locks the support tube or keel sleeve in a receptacle on the floating structure in a manner that allows the support tube or keel sleeve both to pivot relative to the floating structure, and to bend to achieve the desired SCR bend-limiting effect. The diameter of the support tube or keel sleeve is just great enough to allow passage of the riser, and therefore the stiffness of the support tube or keel sleeve is closely matched to that of the SCR. Some embodiments of the invention include a pull tube segment enclosing the riser at a location above the support tube or keel sleeve. The pull tube segment may be attached to the floating structure at one or more attachment points above the keel.

In another aspect of the present invention, in accordance with a preferred embodiment thereof, a method of installing and supporting an SCR on a floating structure comprises the steps of passing a first end of the SCR through the interior of a narrow, flexible support tube or keel sleeve until the first end of the SCR emerges from a top end of the support tube or keel sleeve; attaching a pull-in rigging to the first end of the SCR; fixing the support tube or keel sleeve to the SCR; pulling the SCR and the support tube or keel sleeve, by means of the pull-in rigging, up through a pivot linkage receptacle attached to the floating structure; latching the support tube or keel sleeve in the pivot linkage receptacle; releasing the support tube or keel sleeve from the SCR; and pulling the SCR up through the support tube or keel sleeve to connect the first end of the SCR to the floating structure. In those embodiments employing both a keel sleeve and a pull tube enclosing the SCR at a location above the keel, the method includes the step of fixing a pull tube to the floating structure at a location above the keel, and the step of pulling the SCR through the keel sleeve to connect the first end of the SCR to the floating structure includes the step of passing the SCR through the pull tube before the first end thereof is connected to the structure.

In a preferred embodiment of the invention, the latching pivot mechanism comprises a ball joint pivot mechanism contained in a barrel or housing that fits into the pivot linkage receptacle, and a latching mechanism that is selectively operable to lock the latching pivot mechanism in place within the receptacle. The latching mechanism advantageously comprises a pair of latching plates that are pivotably secured to the bottom of the housing, and that are operable to move from a first position in which they are disengaged from the receptacle, to a second position in which they are in locking engagement with the receptacle.

The various aspects and advantages of the present invention summarized above will be more completely understood with reference to the following detailed description of the preferred embodiments thereof, in connection with the attached drawings.

DETAILED DESCRIPTION OF THE INVENTION

The present invention provides support for a steel catenary riser (SCR) by enclosing the riser within a support tube (such as a bending limiting pipe section or a keel sleeve) and attaching the support tube to the keel of a floating structure. The support tube includes a latching pivot linkage mechanism, and it is supported within a riser guide receptacle that receives the pivot linkage mechanism to accommodate angle changes sustained by the riser as the floating structure changes position due to conditions such as tides, waves, currents, winds, and the like.

Figure 1:
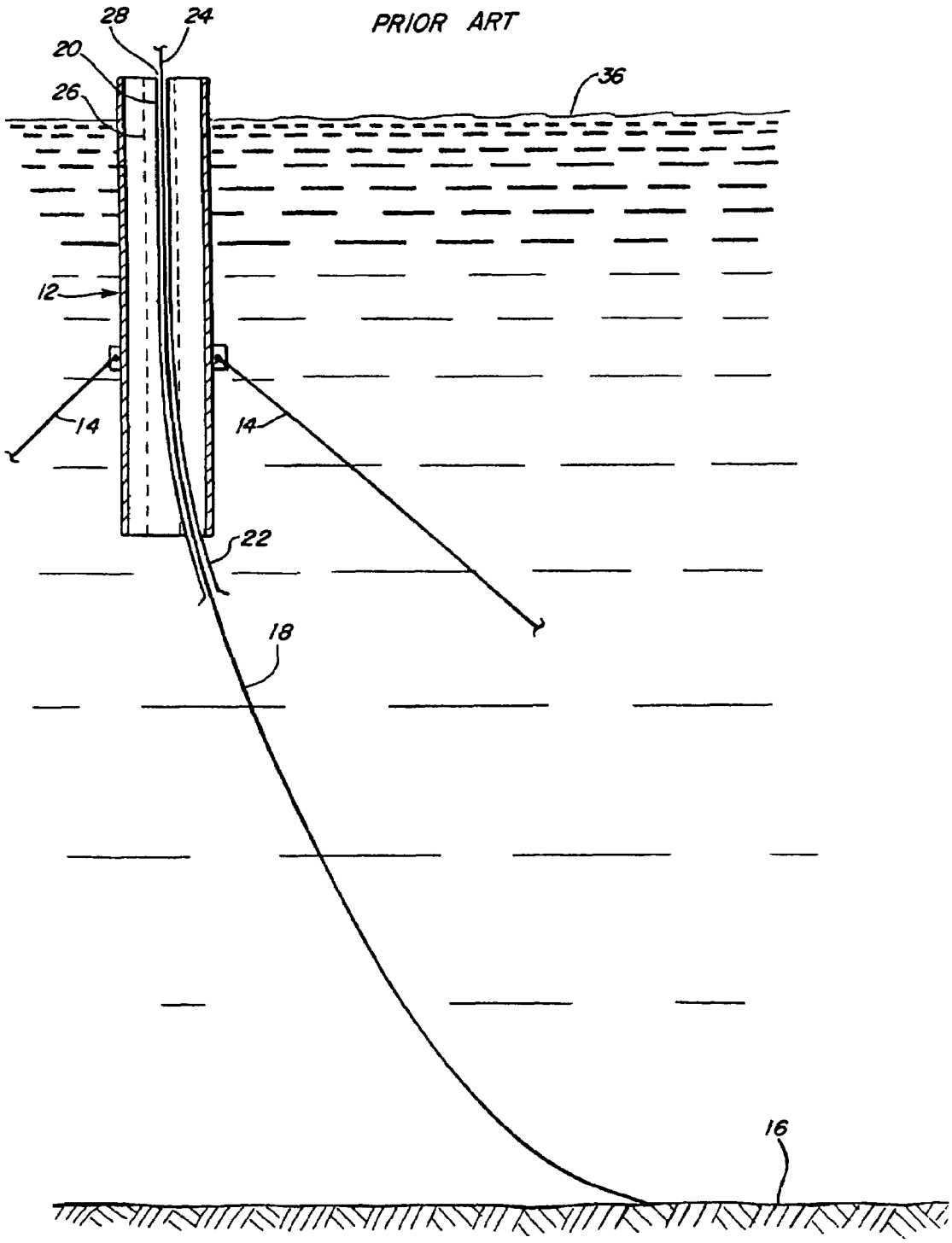
FIG. 1 PRIOR ART
FIG. 1 is a cross-sectional view of a floating offshore structure, as described above, on which a prior art steel catenary riser (SCR) support system has been installed.
Figure 2:
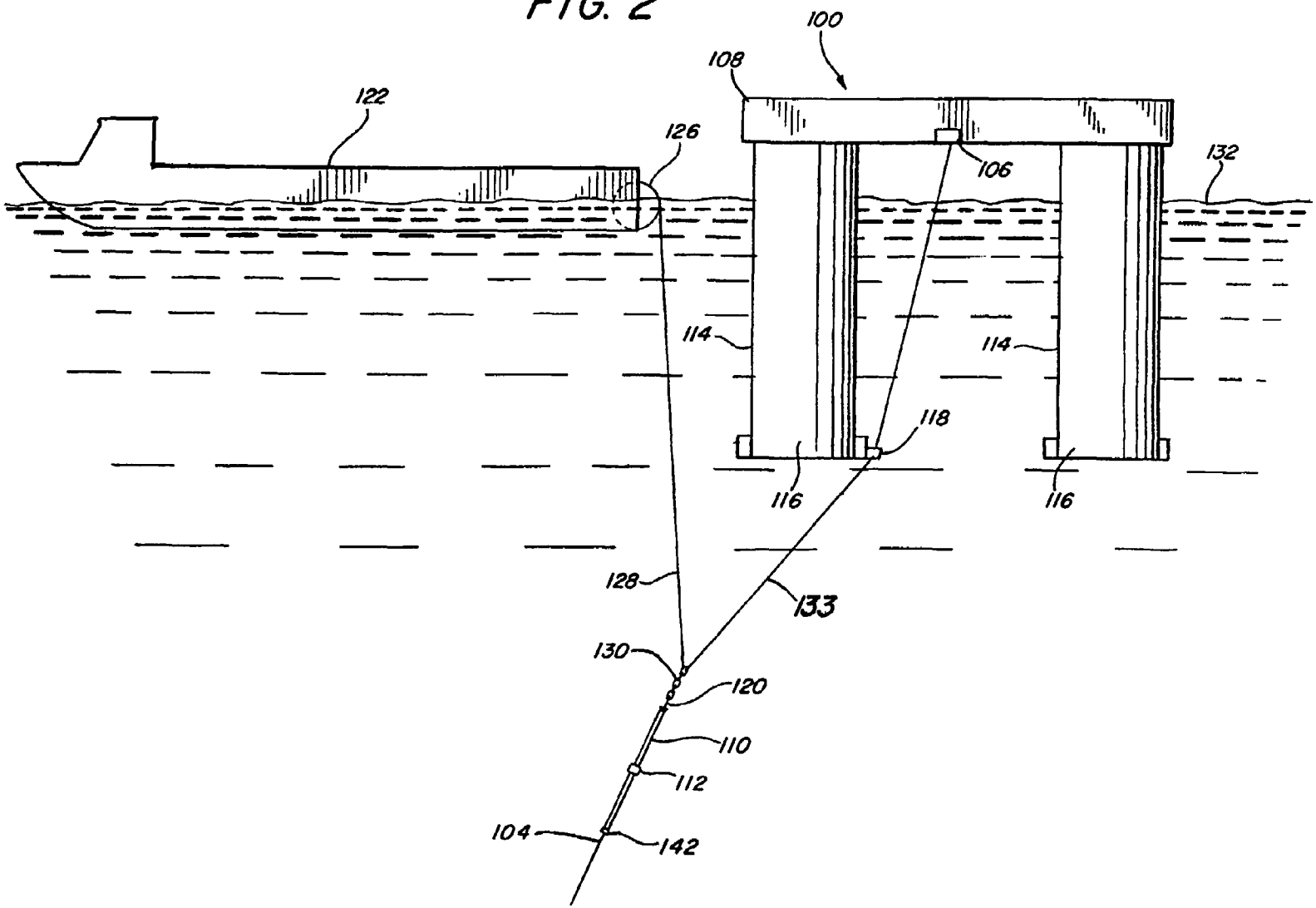
FIG. 2 is an idealized, simplified view of the process of installing an SCR support system, in accordance with a first preferred embodiment of the present invention, on an extendable draft platform (EDP)

FIG. 2 shows a floating structure embodied as an extendable draft platform (EDP) 100 floating on the surface 132 of a body of water. The EDP 100 typically includes a deck 108 supported above the surface 132 by a plurality of buoyant columns 114, the bottom portions of which may be defined as a keel 116. Although the following description refers to an EDP 100, it is to be understood that the present description also applies to any suitable type of floating structure, such as a floating platform, spar, boat, ship, production barge, FPSO (floating production, storage, and offloading structure), and the like.

In accordance with a preferred embodiment of the present invention, an SCR 104 extends from a lower end (not shown) connected to a wellhead (not shown) on the sea floor, to an upper end connected to a yoke 106 operationally connected to the deck 108 of the EDP 100. The SCR 104 is a flexible conduit that is typically formed of a plurality of interconnecting metal (such as steel) tubing or pipe segments axially connected together, as is well-known in the art. The SCR 104 is enclosed within a bending limiting pipe section 110, such as a support tube or a keel sleeve, to be described in more detail below. The support tube or keel sleeve 110 includes a latching pivot mechanism (described below) that advantageously includes a pivot ball 112. A riser guide 118 is fixed to the keel 116 of the EDP 100, and it includes a pivot linkage receptacle (described below) that receives the support tube or keel sleeve 110.

In accordance with a preferred embodiment of the method of the present invention, the SCR 104 may be installed by extending it between the EDP 100 and the seabed (not shown). A method of installation, in accordance with the present invention, comprises a first step of inserting a first end 120 of the SCR 104 into the bottom end of the support tube or keel sleeve 110, and then pulling the SCR 104 through the keel support tube or keel sleeve 110 until the first end 120 of the SCR 104 emerges from the top end of the support tube or keel sleeve 110. The SCR 104 may then be temporarily secured to the support tube or keel sleeve 110 by means of a clamp 142 (see FIG. 4) on the bottom end of the support tube or keel sleeve. These steps may be performed while the support tube or keel sleeve 110 is onboard a service vessel 122. The SCR 104 is then lowered from the service vessel 122 to a point below the keel 116 of the EDP 100. A winch 126 on the vessel 122 may be used to raise and lower the SCR 104 via a pull cable 128 secured to a pull-in rigging 130 attached to the first end 120 of the SCR 104.

Figure 3:
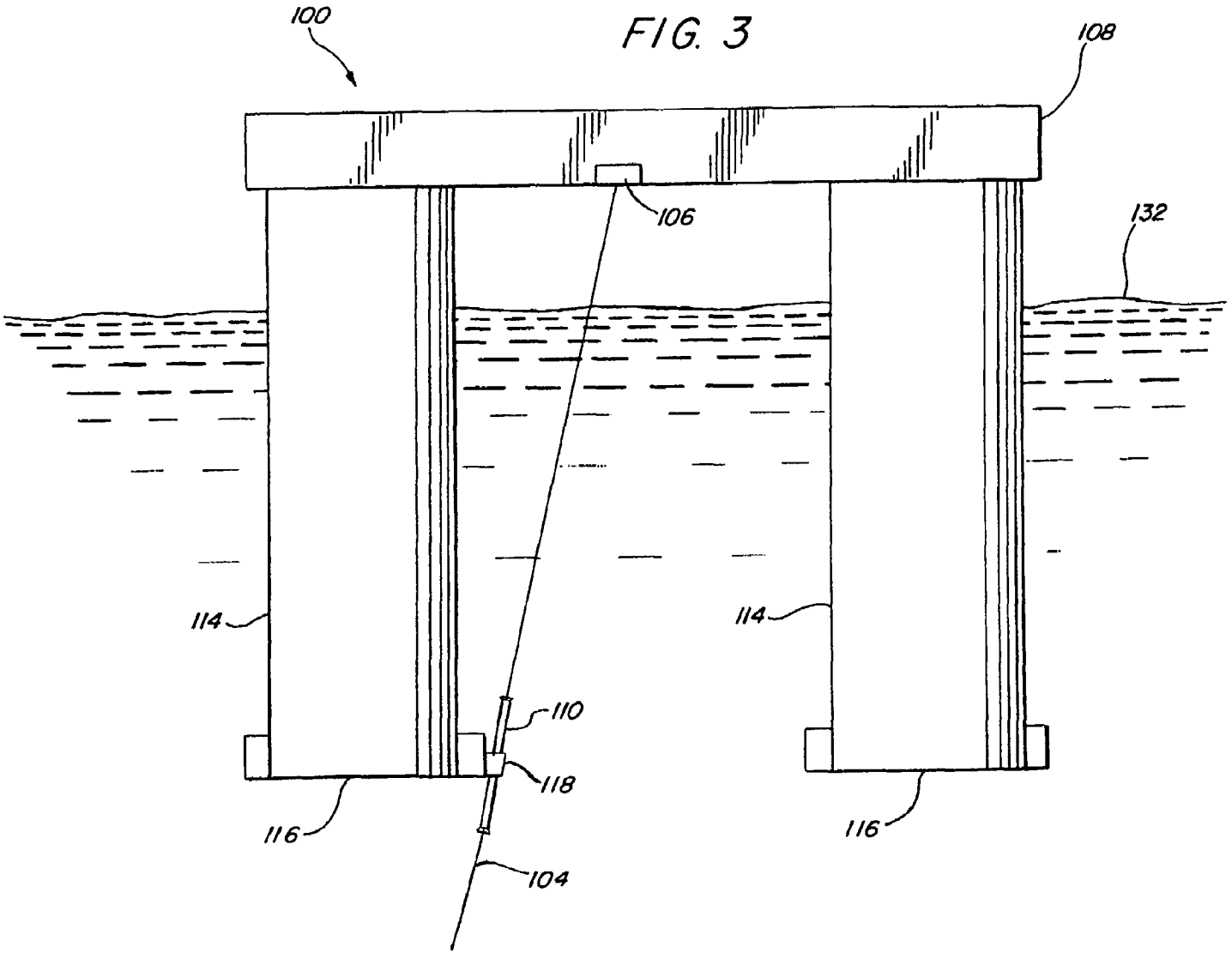
FIG. 3 is an idealized, simplified view of an EDP, as shown in FIG. 2, with the SCR support system of the present invention installed thereon.

Next, by means such as a cable or pull line 133, the SCR 104 is pulled, with the support tube or keel sleeve 110, up through a receptacle (described below) in the riser guide 118 fixed to the keel 116 of the EDP 100. The installation may be furthered by releasing the clamp 142 and pulling the SCR 104 through the support tube or keel sleeve 110 up to the deck 108 of the EDP 100. The SCR 104 is then secured, at the yoke 106, to the EDP 100. The support tube or keel sleeve 110 may then be secured again to the SCR 104 by means of the clamp 142. Thus, as shown in FIG. 3, upon completion of the installation of the SCR 104 in accordance with the present invention, the support tube or keel sleeve 110 is secured within the riser guide 118 and the SCR 104 is attached to the deck 108 of the EDP 100.

Figure 4:
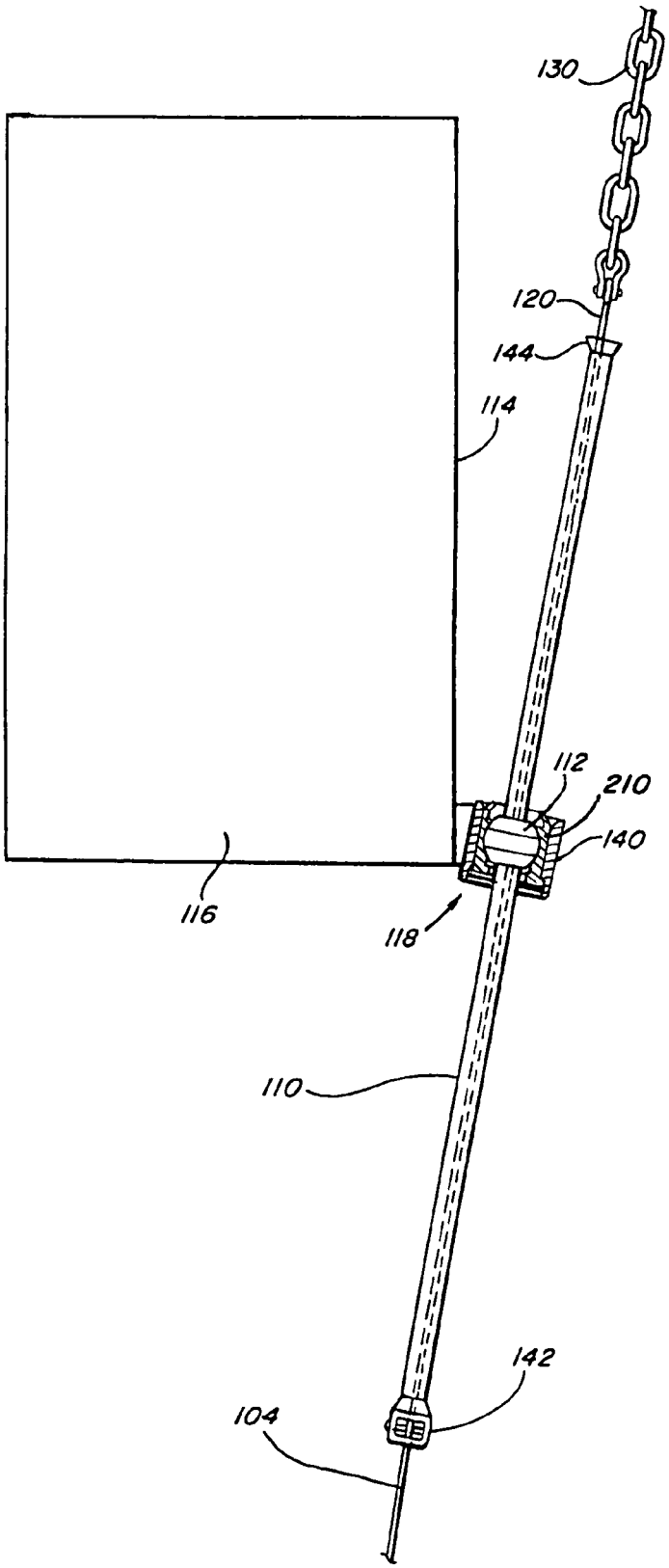
FIG. 4 is a detailed view of the riser support system in accordance with the present invention, after the keel sleeve has been installed in a pivot linkage attached to the keel of a floating structure, but before the SCR has been pulled through the keel sleeve for attachment to the floating structure.

FIG. 4 shows a detailed view of the SCR 104 contained in a support tube or keel sleeve 110 attached to the keel 116 of the EDP 100. As noted above, the support tube or keel sleeve 110 is secured to the keel 116 by a pivot linkage receptacle 140 within the riser guide 118. As discussed on detail below, the pivot linkage receptacle 140 receives the latching pivot mechanism (to be described below) so as to permit the SCR 104 and the support tube or keel sleeve 110 to pivot to relieve stress. The SCR 104 may be axially fixed relative to support tube or keel sleeve by a releasable clamp 142, to maintain the support tube or keel sleeve 110 near an upper end of the SCR 104 for installation in the desired position.

Figure 5:
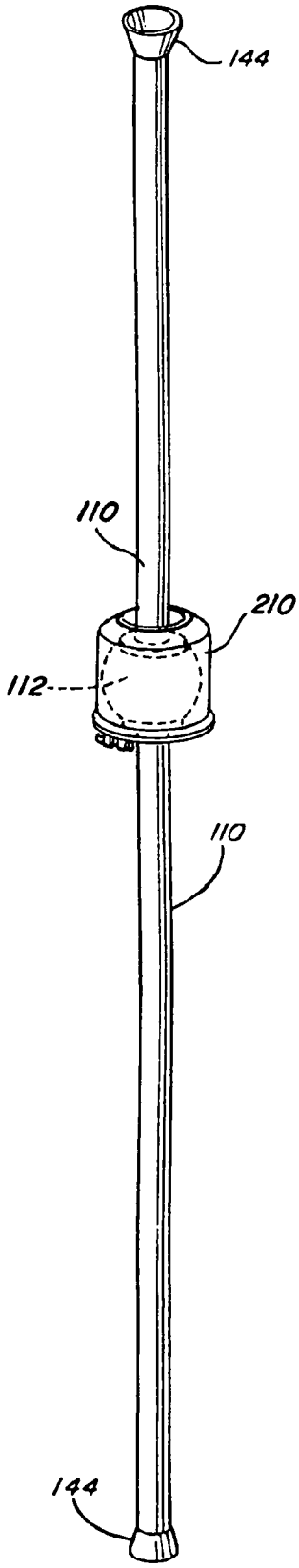
FIG. 5 is a perspective view of a keel sleeve of the type employed in the SCR support system of the present invention.

As shown in detail in FIG. 5, the support tube or keel sleeve 110 is preferably formed as a tubular length of a flexible steel or other suitable flexible material, and it preferably is formed with flared ends 144, as shown. The support tube or keel sleeve 110 is designed to be flexible, so that it can bend with the SCR 104 that passes through it. The pivot ball 112, which is advantageously located near the mid-point along the length of the tube or sleeve 110, is contained within a tubular housing or barrel 210 that is a part of a latching pivot mechanism, described in detail below. The inside diameter of the tube or sleeve 110 is (except for the flared ends 144 and the pivot ball 112) only slightly larger than the outside diameter of the SCR 104, and thus it is advantageously smaller than the diameter of the pull-in rigging 130, as shown in FIG. 4. Thus, the tube or sleeve 110 may be made with a stiffness that is approximately equal to, or at least does not greatly exceed, that of the SCR 104.

Figure 6:
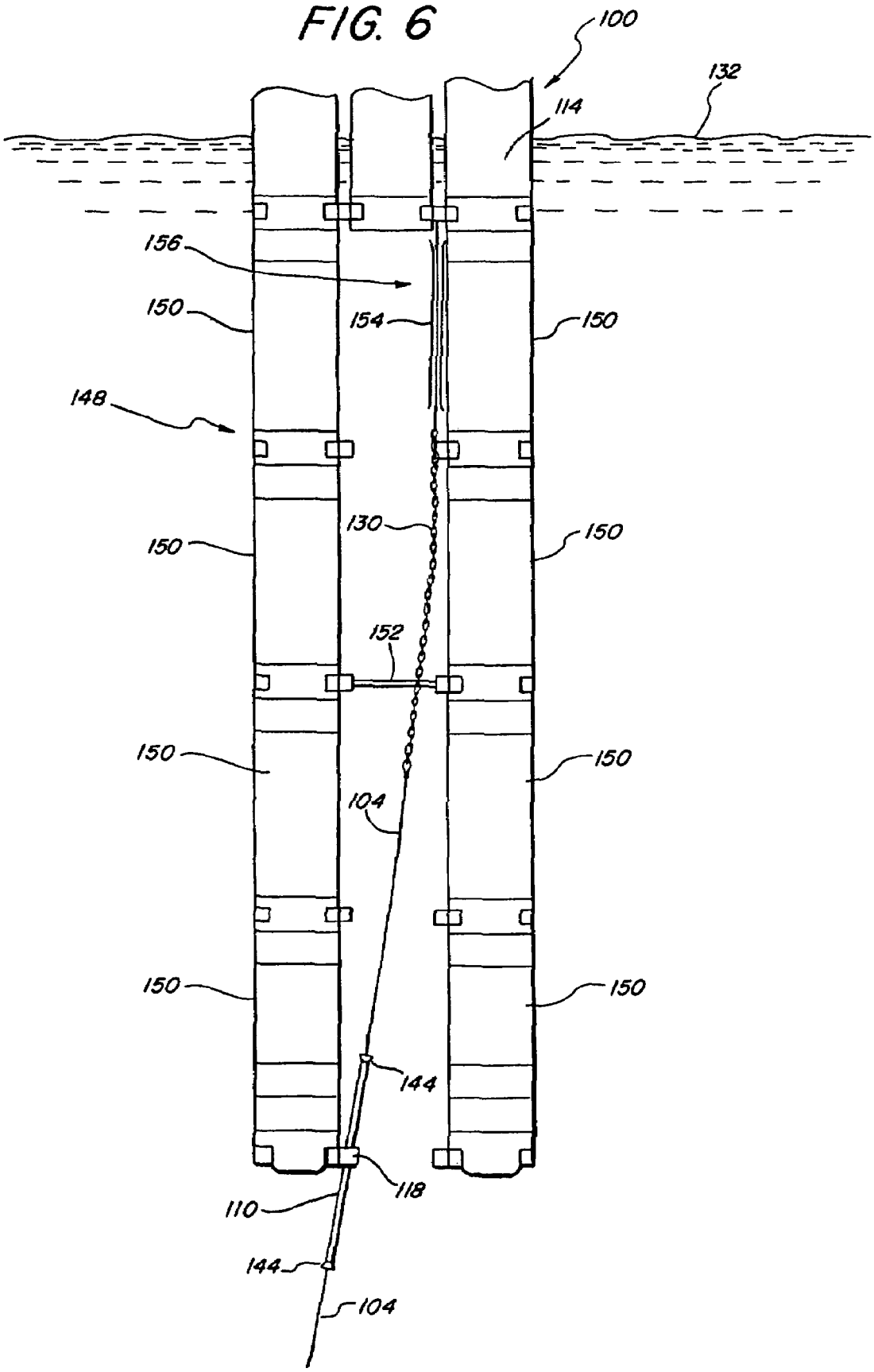
FIG. 6 is an idealized, simplified view of a spar-type platform on which an SCR support system in accordance with a second preferred embodiment of the present invention has been installed.

FIG. 6 shows an embodiment of the riser support system of the present invention for supporting an SCR 104 from a spar-type floating platform 100', which has a hull 148 comprising a plurality of cells 150 interconnected end to end, as is well-known in the art. At least one lateral support bar 152 may be used to support the hull 148 and to limit lateral movement of the SCR 104. A flexible pull tube 154 encloses the SCR 104 and is fixed to the hull 148 at a location 156 above the keel sleeve or support tube 110. The pull tube 154 further limits stresses in the SCR 104.

FIGS. 7-11 show a preferred embodiment of a pivot linkage receptacle 140, adapted and configured for attachment to the keel of a floating structure, and a latching ball joint pivot mechanism 200 that is configured to be latched into the receptacle 140. The latching ball joint pivot mechanism 200 comprises, in terms of its major components, a tubular housing or barrel 210, the pivot ball 112 of the support tube or keel sleeve 110, and a pair of arcuate latching plates 230 that are located on the bottom surface of the barrel 210 and that are movable between a latched position and an unlatched position relative to the receptacle 140, as discussed below.

Figure 7:
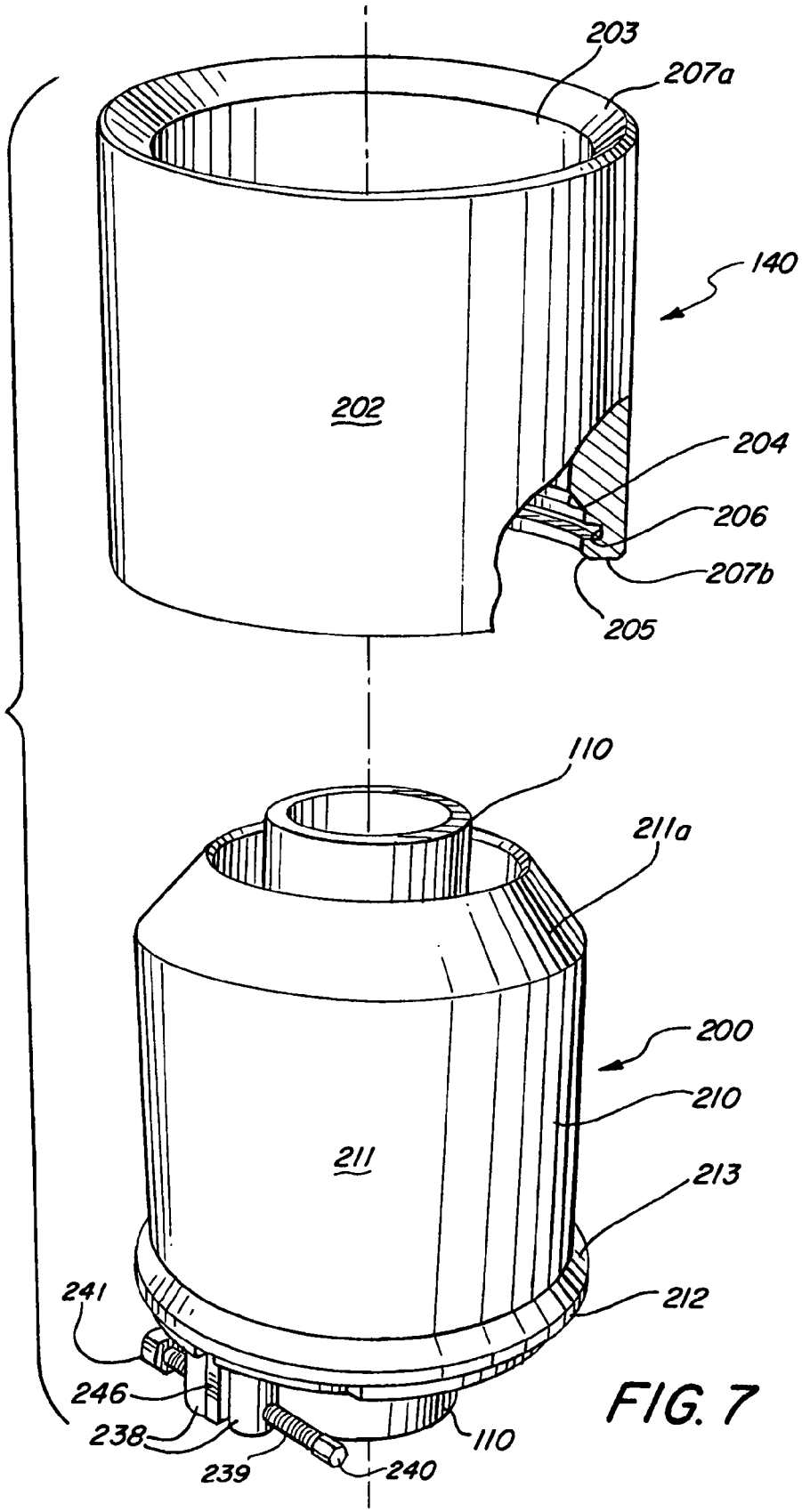
FIG. 7 is an exploded perspective view of an exemplary pivot linkage receptacle and a latching ball joint pivot mechanism employed in the present invention.

As best shown in FIG. 7, the pivot linkage receptacle 140 is generally of tubular construction, having an exterior surface 202 of substantially uniform or constant diameter, and a main interior surface defining a bore 203. The interior surface has an outwardly-tapered shoulder 204 near the lower end thereof. The shoulder 204 connects the main interior surface 203 with an enlarged-diameter lower end interior surface portion 205, in which an annular latching groove 206 is formed. The exterior surface 202 of the pivot linkage receptacle 140 may be welded or attached by other means to the keel 116, or to the riser guide 118. The exterior surface 202 and the interior surface 203 may be joined by annular oblique and/or transverse surfaces 207*a*, 207*b* at the top and bottom, respectively. Preferably, at least part of the surfaces adjacent to the bore 203 of the receptacle 140 will be inclined inward, providing easy entry for the support tube or keel sleeve 110 with the ball joint pivot mechanism 200.

The barrel 210 of the pivot mechanism has a generally cylindrical exterior surface 211 with a frustoconical upper portion 211*a*, and an annular flange 212 near the lower end thereof. The flange 212 has a tapered upper surface 213 that mates with the tapered shoulder 204 of the receptacle when the barrel 210 is inserted into the receptacle, so that the mating surfaces 204, 213 function as stop surfaces to position the barrel 210 axially within the receptacle 140 for proper functioning of the latching mechanism, as will be described below. The flange 212 of the barrel 210 has a flat, annular bottom surface 214.

Figure 8:
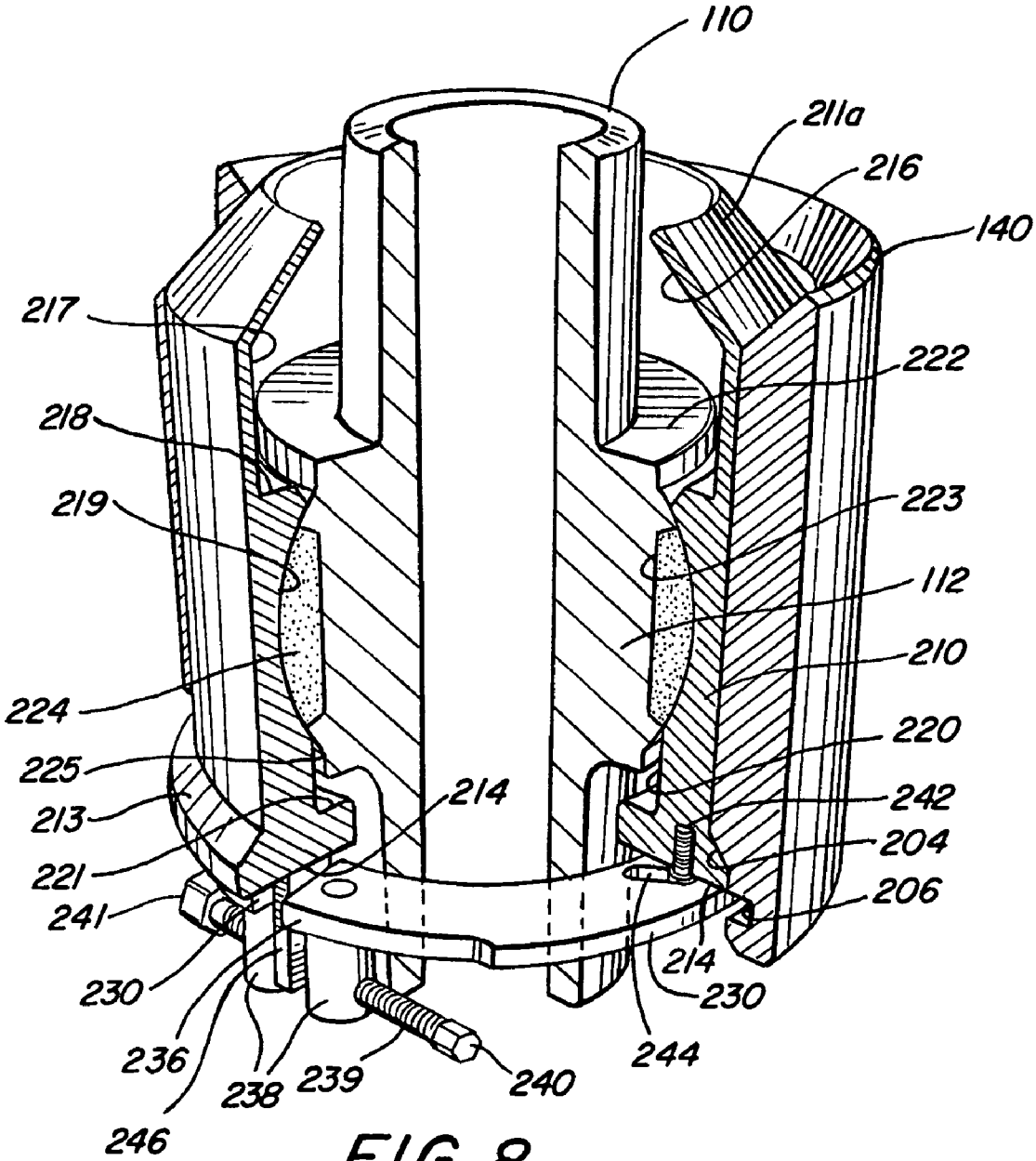
FIG. 8 is a partially cut-away perspective view of the pivot linkage receptacle and the latching ball joint pivot mechanism of FIG. 7, showing the pivot mechanism received in the receptacle in an unlatched position.
Figure 9:
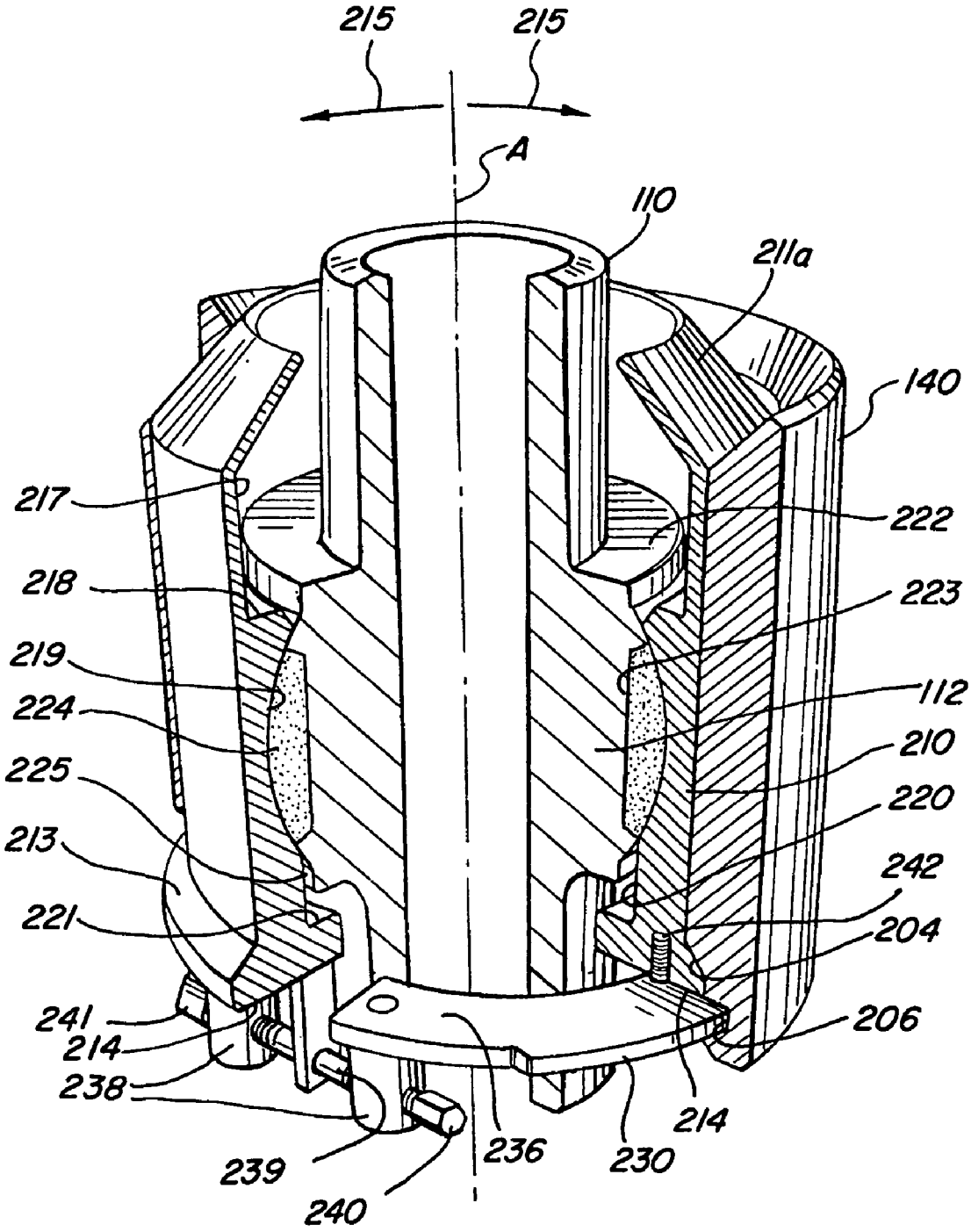
FIG. 9 is a partially cut-away perspective view of the pivot linkage receptacle and latching pivot mechanism of FIG. 7, showing the pivot mechanism received in the receptacle in a latched position.

As shown in FIGS. 8 and 9, sequentially from the upper end of the barrel 210, the interior bore of the barrel 210 includes an inwardly-tapered upper interior surface 216, an upper cylindrical surface 217, an inwardly-directed annular upper shoulder 218, a concave ball joint surface 219, a lower cylindrical interior surface 220, and an inwardly-directed annular lower shoulder 221. The outside diameter of the exterior barrel surface 211 should be slightly smaller than the inside diameter of the pivot linkage receptacle 140 to allow the barrel 210 to slide into the bore 203 of the receptacle 140. The dimensions of the barrel flange 212 and the barrel outer cylindrical surface 211 should be also slightly smaller than the corresponding receptacle shoulder 204 and the cylindrical lower end surface portion 205, so that the barrel 210 may fit into the bore 203 of the pivot linkage receptacle 140.

As shown in FIGS. 8 and 9, the flexible keel sleeve or support tube 110 has an annular joint flange 222 just above the pivot ball 112. The flange 222 is positioned to be received in the bore of the barrel 210 above the upper interior shoulder 217 of the barrel 210. The pivot ball 112 may advantageously be formed with an annular recess or pocket 223 in which is installed a low-friction anti-galling material 224, such as, for example, an aluminum-bronze bearing alloy, thereby providing a low friction pivot bearing surface that seats against the concave ball joint surface 219 in the bore of the barrel 210. Thus, the pivot ball 112 and the concave ball joint surface 219 form a pivoting ball joint that allows the support tube or sleeve 110 to pivot relative to the axis A of the barrel 210, as indicated by the arrows 215 in FIG. 9. Angular travel of the support tube or sleeve 110 in pivoting is limited by an annular stop surface 225 on the tube or sleeve 110 below the ball 112, which stop surface abuts against the lower cylindrical surface 220 in the bore of the barrel 210 at the limits of travel of the sleeve or tube 110.

Figure 10:
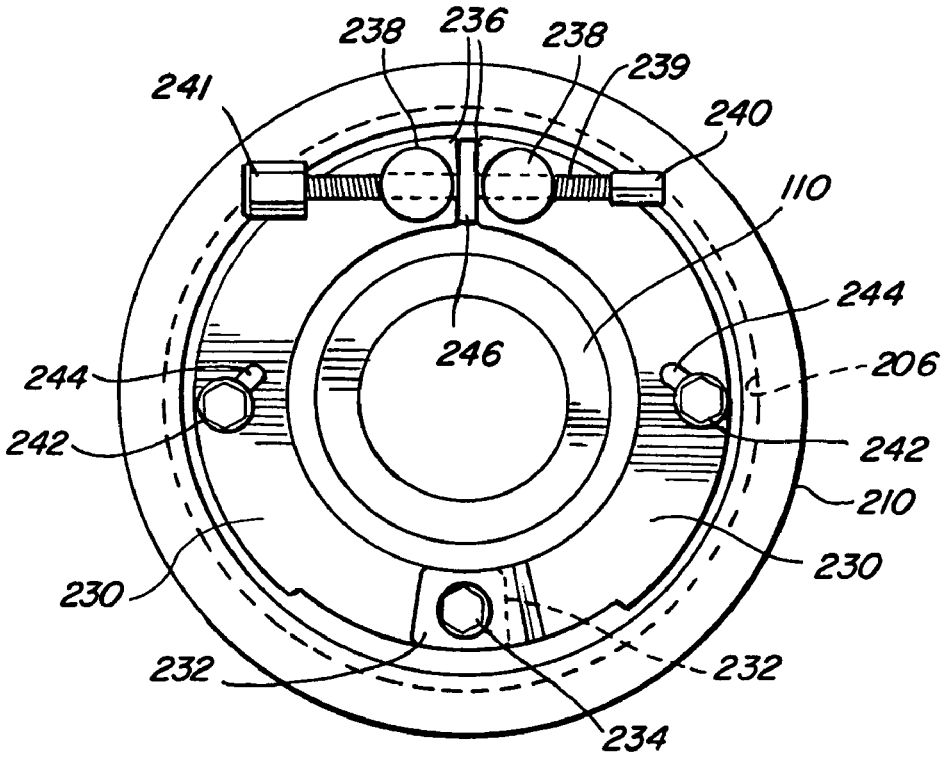
FIG. 10 is a bottom plan view of the pivot linkage receptacle and latching pivot mechanism of FIG. 7, showing the pivot mechanism received in the receptacle in an unlatched position.
Figure 11:
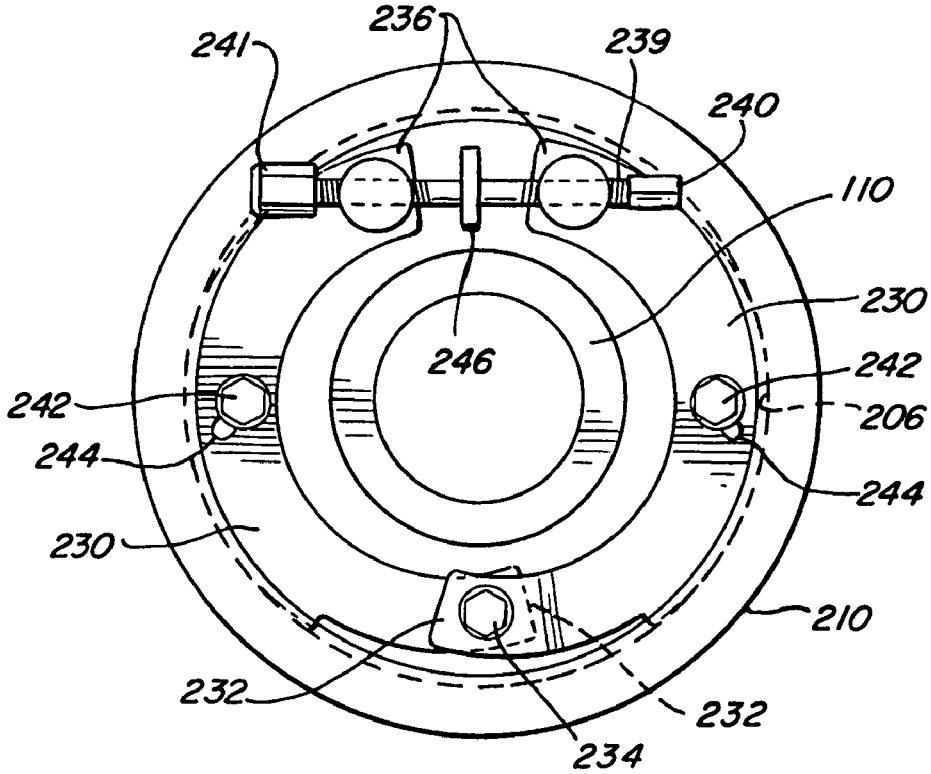
FIG. 11 is a bottom plan view of the pivot linkage receptacle and latching pivot mechanism of FIG. 7, showing the pivot mechanism received in the receptacle in a latched position.

As best shown in FIGS. 10 and 11, the latching mechanism comprises first and second latching elements that, in the preferred embodiment, are in the form of arcuate (i.e., approximately semicircular) latching plates 230, each of which has a first end 232 that is pivotally connected to the first end of the other plate by a pivot bolt 234 that is threaded into the flat bottom surface 214 of the barrel bottom flange 212. Each of the plates 230 has a second end 236 that is opposed to and separated from the second end of the other plate by a gap, the width of which is varied, as described below, as the plates are pivoted about an axis defined by the pivot bolt 234.

As shown in FIGS. 7-11, a transversely-threaded post 238 extends downwardly from the second end 236 of each of the latching plates 230. A latching bolt 239, the purpose and operation which will be described below, is threaded through the posts 238. The latching bolt 239 has a first end terminating in a hex-head 240 configured to receive a socket wrench or like implement (not shown) that may be employed by an ROV (not shown) to turn the latching bolt 239, as discussed below. The opposite end of the latching bolt 239 terminates in an upset 241 that forms a stop element to limit the movement of the posts 238, as discussed below.

In a preferred embodiment of the invention, the latching bolt 239 has a first portion, adjacent the hex head end 240, that is threaded in a first direction, i.e., a right-hand thread, and a second portion, adjacent the upset end 241, that is threaded in the opposite direction (i.e., a left-hand thread). The respective posts 238 are threaded to accommodate the portion of the latching bolt 239 that is threaded into that post. Thus, the post 238 through which the right-hand threaded portion of the latching bolt 239 is threaded likewise is right-hand threaded, while the post 238 through which the left-hand threaded portion of the latching bolt 239 is threaded likewise is left-hand threaded. Between the threaded first and second portions of the latching bolt 239 is an intermediate portion that is smooth (not threaded). The smooth portion of the latching bolt 239 is journaled in a retention element 246 that extends downward from the flat bottom surface 214 of the barrel bottom flange 212 between the posts 238, as best shown in FIGS. 10 and 11.

Each of the latching plates 230 is seated on, and movably secured to, the flat bottom surface 214 of the barrel bottom flange 212 by a plate bolt 242 that is threaded into the flat bottom surface 214 of the barrel bottom flange 212 through an elongate slot 244 in the respective plate 230. The combination of the pivoting provided by the pivot bolt 234 and the "play" or movement allowed by the elongate slots 244 allows the latching plates 230 to move from a radially withdrawn or "unlocked" position (FIGS. 8 and 10) to a radially extended or "locked" position (FIGS. 9 and 11) in response to the rotation of the latching bolt 239 and the resultant movement of the posts 238 along the length of the latching bolt 239. The posts 238 and the latching bolt 239 thus serve as a latching plate actuation mechanism for moving the latching plates 230 fro a first (unlocked) position to a second (locked) position. Specifically, when the latching bolt 239 is rotated at its hex head end 240 in a first direction (i.e., clockwise), the post 238 in which the first portion of the latching bolt 239 is threaded moves toward hex head end 240, while, because of the reverse threading on the second portion of the latching bolt 239 and in its associated post 238, the post 238 in which the second portion of the latching bolt 239 is threaded moves toward the upset end 241 of the bolt 239. Thus, the two posts 238, and their respective second ends 236 of the latching plates 230, are moved farther apart to pivot the plates 230 into their locked position.

The movement of the plates 230 is reversed when the latching bolt 239 is rotated in the opposite direction (i.e., counter-clockwise) at its hex head end 240, the post 238 in which the first portion of the latching bolt 239 is threaded moves toward the center of the latching bolt 239, as does the post 238 through which the second portion of the latching bolt 239 is threaded, both posts 238 ceasing their travel toward the center of the latching bolt 239 (and toward each other) when they encounter the unthreaded intermediate portion of the latching bolt 239. Thus, as the posts 238 travel along the latching bolt 239 toward each other, they urge their respective second ends 236 of the latching plates 230 are urged closer together, causing the plates 230 to pivot toward their unlocked position.

When the barrel 210 of the pivot mechanism 200 is properly seated within the receptacle 140, as described above, the plates 230 are axially located within the receptacle 140 so as to coincide with the annular latching groove 206. When the barrel 210 is inserted into the receptacle 140, the latching plates 230 are in their withdrawn position (FIGS. 8 and 10) allowing the barrel 210 to be inserted into the receptacle 140. The insertion of the barrel 210 proceeds until the stop surface 213 of the barrel abuts the mating stop surface 204 of the receptacle, at which point the latching plates 230 are properly aligned with the latching groove 206 in the barrel. The pivot mechanism 200 is then latched into the receptacle 140 by turning the latching bolt 239 at its hex head end 240 (by means of, for example, an ROV, not shown) in the first direction, as described above, whereby the latching plates 230 are pivoted to their extended or locked position (FIGS. 9 and 11), in which they are received in the latching groove 206.

Although the present invention has been described with reference to specific embodiments, these embodiments are illustrative only and not limiting. Specifically, various modifications and variations of the present invention will suggest themselves to those skilled in the pertinent arts, such as, for example, variations in the specific order of the method steps described herein, and, as suggested above, in the specific structure of the latching pivot mechanism described herein and illustrated in the drawings. These variations and modifications, as well as others that might suggest themselves from this disclosure, are considered within the spirit and scope of the present invention, as defined in the claims that follow.

What is claimed is:

1. Apparatus for supporting a steel catenary riser (SCR) on a floating structure, comprising:

a receptacle attached to the floating structure;

a flexible support tube enclosing the SCR and dimensioned so as to support the SCR while allowing the SCR to bend; and a pivoting mechanism on the support tube that secures the support tube in the receptacle in a manner that allows the support tube to pivot relative to the floating structure, wherein the pivoting mechanism includes a latching mechanism that is operable selectively to latch the pivoting mechanism within the receptacle.

2. The apparatus of claim 1, wherein the floating structure includes a keel, wherein the receptacle is attached to the keel, wherein the support tube is a keel sleeve, and wherein the apparatus further comprises a pull tube segment enclosing the riser at a location above the keel sleeve, wherein the pull tube segment is attached to the floating structure above the keel sleeve.

3. The apparatus of claim 1, wherein the pivoting mechanism comprises:

a barrel dimensioned to fit inside the receptacle; and a ball pivot mounted within the barrel so as to be pivotable relative to the barrel.

4. The apparatus of claim 3, further comprising a latching mechanism, operably associated with the barrel, and operable selectively to latch the barrel within the receptacle.

5. The apparatus of claim 4, wherein the barrel has a bottom surface, and wherein the latching mechanism comprises:

a pair of latching elements mounted on the bottom surface of barrel so as to be movable between a first position that is out of engagement with the interior of the receptacle and a second position that is in a locking engagement with the interior of the receptacle when the barrel is positioned within the receptacle; and a latching element actuation mechanism operable on the latching elements so as to move them between the first position and the second position.

6. The apparatus of claim 5, wherein each of the latching elements is a plate that is pivotable between a radially withdrawn position and a radially extended position in response to the latching element actuation mechanism.

7. An apparatus for supporting a steel catenary riser (SCR) on a floating structure having a keel, comprising:

a flexible keel sleeve enclosing a portion of the length of the SCR;

a pivot mechanism on the keel sleeve; and a pivot linkage receptacle attached to the keel of the floating structure and internally dimensioned to receive the pivot mechanism;

wherein the pivot mechanism secures the keel sleeve within the receptacle in a manner that allows the keel sleeve to pivot relative to the floating structure, and wherein the pivot mechanism comprises a latching mechanism operable to lock the pivot mechanism into the receptacle.

8. The apparatus of claim 7, wherein the receptacle includes an internal groove, and wherein the latching mechanism includes a pair of latching elements that are movable between an unlocked position in which they are not seated in the groove, and a locked position in which they are seated in the groove.

9. The apparatus of claim 8, wherein the pivot mechanism includes a barrel having a bottom surface, wherein the barrel is dimensioned to be received d in the receptacle, and wherein each of the latching elements comprises a latching plate having has a first end pivotally attached to the bottom surface, and a second end that is spaced from the second end of the other latching element, whereby the latching plates are movable from the unlocked position to the locked position by pivoting so as to increase the distance between their respective ends.

10. The apparatus of claim 9, wherein the latching mechanism further comprises a latching bolt operably coupled to the latching plates so that, when the bolt is rotated in a first direction, it moves the plates from the unlocked position to the locked position, and when the bolt is rotated in a second direction, it moves the plates from the locked position to the unlocked position.

11. The apparatus of claim 7, wherein the pivot mechanism comprises a ball joint pivot.

12. A method of supporting a steel catenary riser (SCR) from a floating structure, comprising the steps of:

providing a flexible support tube comprising a pivot linkage that includes a latching mechanism;

passing a first end of the SCR through the interior of the flexible support tube until the first end of the SCR emerges from a top end of the support tube;

attaching a pull-in rigging to the first end of the SCR;

fixing the support tube to the SCR;

pulling the SCR and the support tube, by means of the pull-in rigging, up through a receptacle attached to the floating structure;

securing the support tube in the receptacle by inserting the pivot linkage into to the receptacle and then operating the latching mechanism to latch the pivot linkage within the receptacle;

releasing the support tube from the SCR;

pulling the SCR up through the support tube; and connecting the first end of the SCR to the floating structure.

13. The method of claim 12, comprising the further step, after the step of pulling the SCR through the support tube, of again fixing the support tube to the SCR.

14. The method of claim 12, further comprising the step of fixing a pull tube to the floating structure at a location above the keel, and wherein the step of pulling the SCR through the support tube includes the step of passing the SCR through the pull tube before the first end thereof is connected to the structure.

15. The method of claim 12, wherein the floating structure has a keel, and wherein the receptacle is attached to the keel.

16. The method of claim 12, wherein the step of operating the latching mechanism is performed by a remotely-operated vehicle (ROV).

17. Apparatus for supporting a steel catenary riser (SCR) on a floating structure, comprising:

a receptacle attached to the floating structure;

a flexible support tube enclosing the SCR and dimensioned so as to support the SCR while allowing the SCR to bend; and a pivoting mechanism on the support tube that secures the support tube in the receptacle in a manner that allows the support tube to pivot relative to the floating structure, wherein the pivoting mechanism comprises:

a barrel dimensioned to fit ii side the receptacle;

a ball pivot mounted within the barrel so as to be pivotable relative to the barrel; and a latching mechanism, operably associated with the barrel, and operable selectively to latch the barrel within the receptacle.

18. The apparatus of claim 17, wherein the floating structure includes a keel, wherein the receptacle is attached to the keel, wherein the support tube is a keel sleeve, and wherein the apparatus further comprises pull tube segment enclosing the riser at a location above he keel sleeve, wherein the pull tube segment is attached to the floating structure above the keel sleeve.

19. The apparatus of claim 17, wherein the barrel has a bottom surface, and wherein the latching mechanism comprises:

a pair of latching elements mounted on the bottom surface of barrel so as to be movable between a first position that is out of engagement with the interior of the receptacle and a second position that is in a locking engagement with the interior of the receptacle when the barrel is positioned within the receptacle; and a latching element actuation mechanism operable on the latching elements so as to move them between the first position and the second position.

20. The apparatus of claim 19, wherein each of the latching elements is a plate that is pivotable between a radially withdrawn position and a radially extended position in response to the latching element actuation on mechanism.

* * * * *

UNITED STATES PATENT AND TRADEMARK OFFICE

CERTIFICATE OF CORRECTION

PATENT NO. : 7,467,914 B2
APPLICATION NO. : 11/225148
DATED : December 23, 2008
INVENTOR(S) : Lyle Finn and Gerald Crotwell It is certified that error appears in the above-identified patent and that said Letters Patent is hereby corrected as shown below:

The punctuation ":" in column 3, line 7 should read as --;--

The word "fro" in column 7, line 1 should read as --from--

The word "has" in column 8, line 59 should be deleted

The letter --a-- needs to be inserted between "comprises" and "pull" in column 10, line 18

The word "he" in column 10, line 19 should read as --the--

The word "on" in column 10, line 38 should be deleted

Signed and Sealed this

Third Day of March, 2009

JOHN DOLL
*Acting Director of the United States Patent and Trademark Office*